US005900589A

United States Patent [19]

Brunt

[11] Patent Number: 5,900,589

[45] Date of Patent: May 4, 1999

[54] SILVER RIBBON CABLE

[76] Inventor: Douglas R Brunt, Surrey, Canada

[21] Appl. No.: 08/892,886

[22] Filed: Jul. 15, 1997

[30] Foreign Application Priority Data

Jul. 19, 1996 [CA] Canada ..... 2180983

[51] Int. Cl.[6] ..... H01B 7/00

[52] U.S. Cl. ..... 174/120 R; 174/117 FF; 174/36

[58] Field of Search ..... 174/36, 117 FF, 174/102 SC, 120 R, 115, 94 R

[56] References Cited

U.S. PATENT DOCUMENTS

| | | | |
|---|---|---|---|
| 3,617,617 | 11/1971 | Katz | 174/120 |
| 4,423,282 | 12/1983 | Suzuki et al. | 174/36 |
| 5,003,126 | 3/1991 | Fujii et al. | 174/36 |
| 5,455,383 | 10/1995 | Tanaka | 174/36 |

*Primary Examiner*—Kristine Kincaid
*Assistant Examiner*—William H. Mayo, III

[57] ABSTRACT

An electrical transmission cable for audio range and higher frequency signals uses a signal carrying conductor made of silver, in pure or nearly pure form, with a specific rectangular cross section. A dedicated ground conductor of similar material is used, the overall result being an improvement in impedance characteristics.

1 Claim, 1 Drawing Sheet

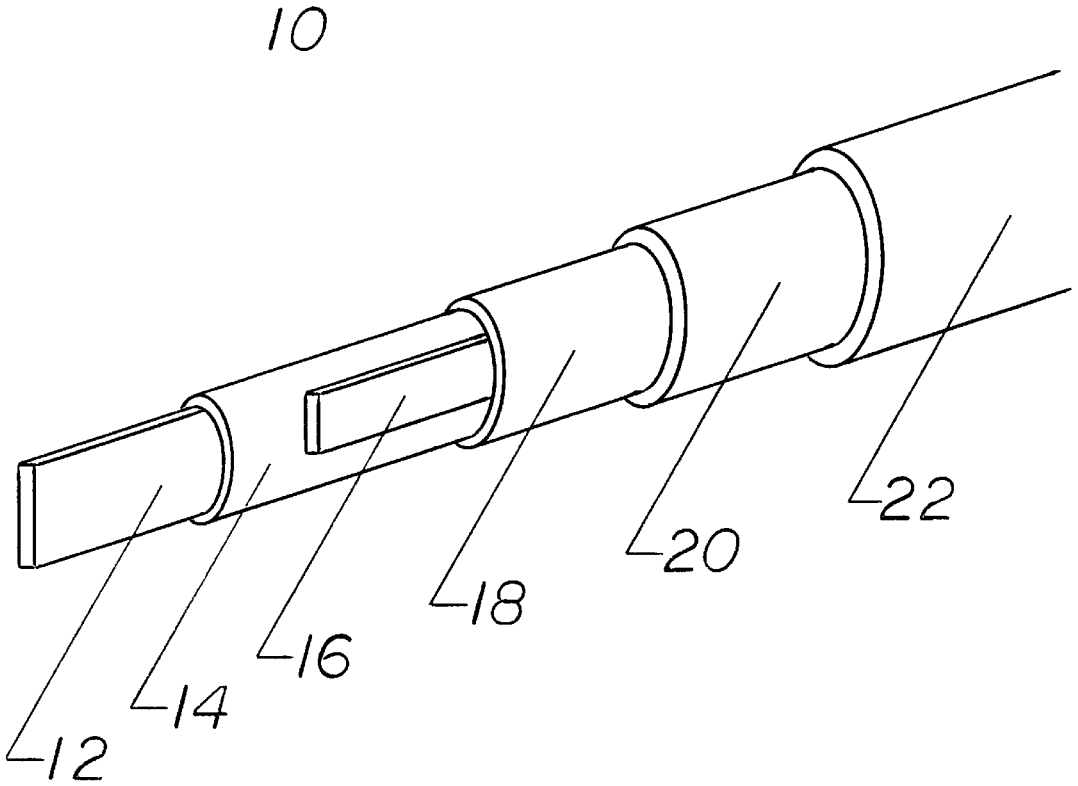
10
12
14
16
18
20
22

SILVER RIBBON CABLE

BACKGROUND OF THE INVENTION

1. Field of the Invention

The present invention relates to a cable for the transmission of electrical signals. Transmission performance is substantially improved over conventional cables for many applications, by the use of very pure silver as the conductive material, together with specific conductor cross-sectional shape and placement within the cable.

2. Description of the Related Art

A wide variety of cables are known and available, designed and made according to established, as well as theoretical principles of electrical signal transmission. The function of this type of cable in the most basic sense is simply to provide a conductive path for the signal to pass from one device to another. The cable will also, in most cases, establish contact between the grounded or zero voltage references of the devices being connected. This is often accomplished by the inclusion of a "shield", which is usually a tubular conductive material such as metallic foil, or a braid woven from strands of conductive material. The shield completely encloses the signal-carrying conductor or conductors and is electrically connected to ground potential at one or both ends of the cable. In this way, outside electromagnetic interference is substantially prevented from influencing the signal-carrying conductor, and the ground or reference connection between devices is established.

The most effective cable accomplishes the functions of signal transmission, ground connection, and shielding without adversely affecting the character of the signal. In other words, degradation of the signal due to the effects of resistance, capacitance, and inductance is minimized, although all electrical cables by their nature will exhibit all of these properties to some extent.

Upper frequency limit or effective bandwidth of a cable design is determined by the extent to which these properties can be eliminated.

One of the problems with conventional cables is that of the well known and documented "skin effect". This arises from the fact that the self inductance of a conductor is greatest at the center of the conductor, because the magnetic field set up by the changing current has the greatest rate of change at the center of the conductor. This means that higher frequency signals will encounter a lower impedance path toward the outside of the conductor and will concentrate there, reducing the effective cross-sectional area, and therefore increasing the impedance of the conductor for these frequencies. Thus, signals of higher frequency will encounter higher impedances than signals of lower frequency, and the relationships between amplitudes of different frequency signals being transmitted are distorted.

"Skin effect" has been documented at audio frequencies. Higher in the spectrum, at radio frequencies, virtually all of the current flows at the surface of the conductor, due to this phenomenon. Higher again at microwave frequencies, conductors are often hollow, because current flows only at the outermost surface. From the point of view of maximizing the linearity of signal transmission through a cable, any means of reducing this effect is central to the pursuit of increased bandwidth.

A similarly parasitic effect of bandwidth limitation is created by cable capacitance, since the proximity of the signal conductor and grounded conductors within the cable allows capacitive losses to occur, and again the problem increases with frequency.

BRIEF SUMMARY OF THE INVENTION

The object of the present invention is to provide a cable for the transmission of electrical signals which is superior to conventional means in its ability to provide overall low impedance, very low self inductance, controllable capacitance, and high bandwidth. To achieve this, an insulated, high purity silver conductor of specific rectangular cross-section is used as the signal-carrying conductor. An additional conductor is provided within the cable whose sole purpose is to provide a dedicated ground or zero reference connection between devices. This dedicated ground conductor may be of the same composition and cross section as the signal carrying conductor. The assembly of signal-carrying and dedicated ground conductors is insulated and surrounded by a shield against electromagnetic interference, which consists of conventional conductive foil or braid, and is connected to the dedicated ground conductor at one or more points within the cable.

The novelty of the present invention lies in the complimentary and synergistic use of very pure silver and a specifically defined rectangular cross section for the signal carrying conductor, together with provision for an efficient, dedicated ground link, as previously described. The resulting electrical qualities specifically address the increasing need for transmission cables which will accurately transmit complex, high frequency electrical information.

BRIEF DESCRIPTION OF THE DRAWING

Referring to the drawing, the embodiment of the invention shown, a cable 10 comprises a signal-carrying conductor 12 of rectangular cross-section. This conductor is made of silver of high purity. It is enclosed by appropriate insulating material 14. A dedicated ground conductor 16, also made of high purity silver, lies alongside. This arrangement is then enclosed by a second layer of insulating material 18. A conductive shield 20 is applied so as to enclose 12, 14, 16, 18. An outer layer 22 of insulating, protective material encloses the entire assembly.

Although only a single embodiment of the present invention is herein described and illustrated, the present invention is not limited to the features of this embodiment, but includes all variations and modifications within the scope of the claims.

DETAILED DESCRIPTION OF THE INVENTION

The present invention is an electrical transmission cable which employs at least one signal-carrying conductor, of rectangular cross-section, wherein the width of the conductor is made at least five times the thickness. This brings about a significant alteration in the electrical characteristics of the conductor, relative to more conventional conductors of circular cross-section. With regard to self inductance and "skin effect", the ratio of surface area to total conductor mass can be easily doubled by comparison to a circular conductor. All points within the rectangular cross-section are relatively close to the surface, and self inductance is reduced significantly. The same principle holds for the dedicated ground conductor, which may be made of similar dimensions. However, the property of self inductance still exists, even though it has been reduced. A complementary and synergistic effect, which further increases the effective bandwidth of the cable, is achieved by the use of high purity silver as the conductive material. For the purpose of this invention the level of purity is stated as ninety seven percent or greater. At room temperature, pure silver is the most electrically conductive material known. The increase in conductivity provided by this material is equivalent to an enlargement of effective cross sectional area by approximately twenty percent over the same conductor made of copper.

Furthermore, since pure silver exhibits a reduced tendency toward surface oxidation, it is inherently more suitable for high frequency signal transmission where "skin effect" forces current to flow at or near the surface. The contamination of a metal's surface by oxidation brings about an undesirable increase in electrical impedance in this critical area.

When pure silver is also used as a dedicated ground conductor, whose sole purpose is to make the ground connection between devices, this important link is rendered more conductive and substantial benefit is gained. In this case it is preferable and in fact it is generally desirable to enclose the assembly of signal carrying and dedicated ground conductors within a conventional shield of conductive foil or braid, thus separating the functions of electromagnetic shielding and ground connection. The shield and dedicated ground conductors are electrically connected at one or more points within the cable, since they are both at ground potential. The advantages of this overall arrangement are that the dedicated ground connection is less influenced by outside electrical interference, and its conductivity is increased, which can be of particular advantage.

In addition, if the signal-carrying and dedicated ground conductors described herein are placed within the cable in such a manner that the cross sectional width of each conductor lies facing the other, as shown on the drawing, expedient and precise control of cable capacitance can be achieved during the manufacturing process simply by varying the thickness of the insulation between these conductors.

The multiple attributes thus obtained by this invention include low resistance, low self inductance, and expedient control of cable capacitance. Utilization of these attributes may provide a solution to a variety of transmission problems, such as the need for low overall cable impedance in a situation requiring maximum power transfer, or the desirability of a target capacitance value together with low resistance and low inductive impedance for series resonant filtering.

If an electrical cable is constructed according to the foregoing description, the result is a cable with outstanding high frequency characteristics and overall performance for many different applications.

With respect to the matter of terminating the ends of the cable, international standards for type and dimensions of plugs, jacks, and connectors will apply.

This invention requires reasonable standards of workmanship and materials quality when terminating the ends. If a permanent connection is required, standard soldering procedures will suffice.

With respect to the matter of cable length, applications may vary widely, and no restriction is implied as to length.

What is claimed is:

1. A round shaped electrical cable having an ellipsoid shape and a longitudinally extending cable axis, said cable comprising:

(a) one or more signal carrying conductors for carrying electrical signals through said cable, said one or more signal carrying conductors being made of solid silver, the purity of which is at least ninety seven percent and extending parallel to said axis for the entire length of said cable; said one or more signal carrying conductors having a rectangular cross section transverse to said axis along said length, the width being at least five times the thickness of said one or more signal carrying conductors in said rectangular transverse cross section;

(b) a first insulation enclosing said one or more signal carrying conductors;

(c) one or more ground conductors lying parallel to the one or more signal carrying conductors on the outside of said first insulation and having a dedicated ground connection, said one or more ground conductors being made of solid silver, the purity of which is at least ninety seven percent and extending parallel to said axis for the entire length of said cable; said one or more ground conductors having a rectangular cross section transverse to said axis along the said length, the width being at least five times the thickness of said one or more ground conductors in said rectangular transverse cross section;

(d) a second insulation enclosing said one or more ground conductors, the first insulation, and said one or more signal carrying conductors;

(e) a conductive shield enclosing said second insulation, the one or more ground conductors, the first insulation, and said one or more signal carrying conductors;

(f) an electrically insulating cable sheath enclosing said conductive shield, said second insulation, said one or more ground conductors, said first insulation, and said one or more signal carrying conductors, wherein said sheath protects against outside electromagnetic interference.

* * * * *

UNITED STATES PATENT AND TRADEMARK OFFICE

CERTIFICATE OF CORRECTION

PATENT NO. : 5,900,589

DATED : May 4, 1999

INVENTOR(S) : Douglas R. Brunt

It is certified that error appears in the above-identified patent and that said Letters Patent is hereby corrected as shown below:

Column 4, line 43, after "conductors;" insert --wherein said shield protects against outside magnetic interference--.

Column 4, lines 48 and 49, delete ", wherein said sheath protects against outside electromagnetic interference".

Signed and Sealed this

Twenty-first Day of December, 1999

*Attest:*

Q. TODD DICKINSON

*Attesting Officer*

*Acting Commissioner of Patents and Trademarks*